US008091266B2

(12) United States Patent
Huang

(10) Patent No.: US 8,091,266 B2
(45) Date of Patent: Jan. 10, 2012

(54) MULTIFUNCTION TOOL KIT FOR FIREARM MAINTENANCE

(76) Inventor: George Huang, Henderson, NV (US)

( * ) Notice: Subject to any disclaimer, the term of this patent is extended or adjusted under 35 U.S.C. 154(b) by 367 days.

(21) Appl. No.: 12/459,261

(22) Filed: Jun. 29, 2009

(65) Prior Publication Data

US 2010/0325933 A1 Dec. 30, 2010

(51) Int. Cl.
*F41C 27/00* (2006.01)

(52) U.S. Cl. ..... 42/108; 29/270; 29/700

(58) Field of Classification Search ..... 42/108; 29/270, 700

See application file for complete search history.

(56) References Cited

U.S. PATENT DOCUMENTS

| | | | | |
|---|---|---|---|---|
| 3,137,062 | A * | 6/1964 | Green et al. | 29/750 |
| 3,388,753 | A * | 6/1968 | Bardwell | 173/210 |
| 6,243,901 | B1 * | 6/2001 | Elsener et al. | 7/118 |
| 6,922,864 | B2 * | 8/2005 | Clarke et al. | 7/143 |
| 7,637,049 | B1 * | 12/2009 | Samson et al. | 42/108 |
| 7,926,136 | B2 * | 4/2011 | Yale et al. | 7/125 |
| 7,997,170 | B1 * | 8/2011 | Martinez et al. | 81/427.5 |
| 2001/0005913 | A1 * | 7/2001 | Elsener et al. | 7/118 |
| 2004/0129119 | A1 * | 7/2004 | Clarke et al. | 81/439 |
| 2006/0027087 | A1 * | 2/2006 | Gaudron | 89/27.11 |
| 2006/0130621 | A1 * | 6/2006 | Novak et al. | 81/439 |
| 2008/0236210 | A1 * | 10/2008 | Frazer | 70/61 |
| 2008/0271256 | A1 * | 11/2008 | Frazer | 7/128 |
| 2009/0199345 | A1 * | 8/2009 | Morgan | 7/118 |
| 2009/0199941 | A1 * | 8/2009 | Toner et al. | 150/143 |
| 2009/0313800 | A1 * | 12/2009 | Bentley et al. | 29/270 |
| 2010/0242183 | A1 * | 9/2010 | Redfern | 7/128 |
| 2011/0000024 | A1 * | 1/2011 | Johnson et al. | 7/118 |
| 2011/0047769 | A1 * | 3/2011 | Huang | 29/270 |
| 2011/0074288 | A1 * | 3/2011 | Mohr et al. | 315/5.41 |

* cited by examiner

*Primary Examiner* — Bret Hayes
*Assistant Examiner* — Joshua Freeman
(74) *Attorney, Agent, or Firm* — Bennet K. Langlotz; Langlotz Patent & Trademark Works, Inc.

(57) ABSTRACT

A multifunction tool kit for firearm maintenance has a main tool body having one or more facilities for connection of various tool components. The present invention may include a first tool component having an attachment facility adapted to removably connect to one of the facilities for connection of the main tool body. At least one of the opposing ends of the first tool component may terminate in a feature adapted to fit one or more components on a firearm. A feature may be exposed and extend outwards from the opposing sides of the main tool body when the first tool component is connected to the main tool body. The invention may also include additional tool components, such as a thread protector, an alignment gauge having a grease pot with grease cap, a throat erosion gauge, a spacer with pin punch, a stock liner tool, a muzzle wear gauge, and a handle.

19 Claims, 10 Drawing Sheets

MULTIFUNCTION TOOL KIT FOR FIREARM MAINTENANCE

FIELD OF THE INVENTION

The present invention relates to a multifunction tool kit for firearm maintenance that provides multiple tool components that interconnect to perform different functions.

BACKGROUND OF THE INVENTION

Multifunction tool kits for firearm maintenance are desirable for their ability to replace the numerous single function tools required to maintain the M14/M1A and M1 Garand-based weapon platforms with fewer multipurpose, compact tool components. The existing single function maintenance tools and gauges have experienced little change since the original M14 rifle was placed in service by the US military in 1959 and occupy considerable space. Although the M14 was phased out as the standard-issue rifle in the 1960s, many M14s have been returned to service and employed as designated marksman and sniper rifles in the Afghanistan and Iraq wars, and commercial, semi-automatic versions are produced for civilian use.

Multi function tools exist for various firearms, each specialized for the needs of a given firearm. However, these are typically very limited in their functionality. Typically, prior art multi tools are a single unitary body with different shapes formed on it, such as screwdriver tips and hex openings. Other multi tools may have several tools pivotally connected to a handle or frame, in the manner of a Swiss utility knife. While a common handle or frame provides a convenient way to keep the tools together, such an approach still has the limitation of requiring many single function tools.

Therefore, a need exists for a new and improved multifunction tool kit for firearm maintenance. In this regard, the various embodiments of the present invention substantially fulfill at least some of these needs. In this respect, the multifunction tool kit for firearm maintenance according to the present invention substantially departs from the conventional concepts and designs of the prior art, and in doing so provides an apparatus primarily developed for the purpose of replacing the numerous single function tools required to maintain the M14/M1A and M1 Garand-based weapon platforms with fewer multipurpose, compact tool components.

SUMMARY OF THE INVENTION

The present invention provides an improved multifunction tool kit for firearm maintenance, and overcomes the above-mentioned disadvantages and drawbacks of the prior art. As such, the general purpose of the present invention, which will be described subsequently in greater detail, is to provide an improved multifunction tool kit for firearm maintenance that has all the advantages of the prior art mentioned above.

To attain this, the preferred embodiment of the present invention essentially comprises a main tool body having one or more facilities for connection of various tool components. The present invention may include a first tool component having an attachment facility adapted to removably connect to one of the facilities for connection of the main tool body. At least one of the opposing ends of the first tool component may terminate in a feature adapted to fit one or more components on a firearm. A feature may be exposed and extend outwards from the opposing sides of the main tool body when the first tool component is connected to the main tool body. The invention may also include additional tool components, such as a thread protector, an alignment gauge having a grease pot with grease cap, a throat erosion gauge, a spacer with pin punch, a stock liner tool, a muzzle wear gauge, and a handle.

There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
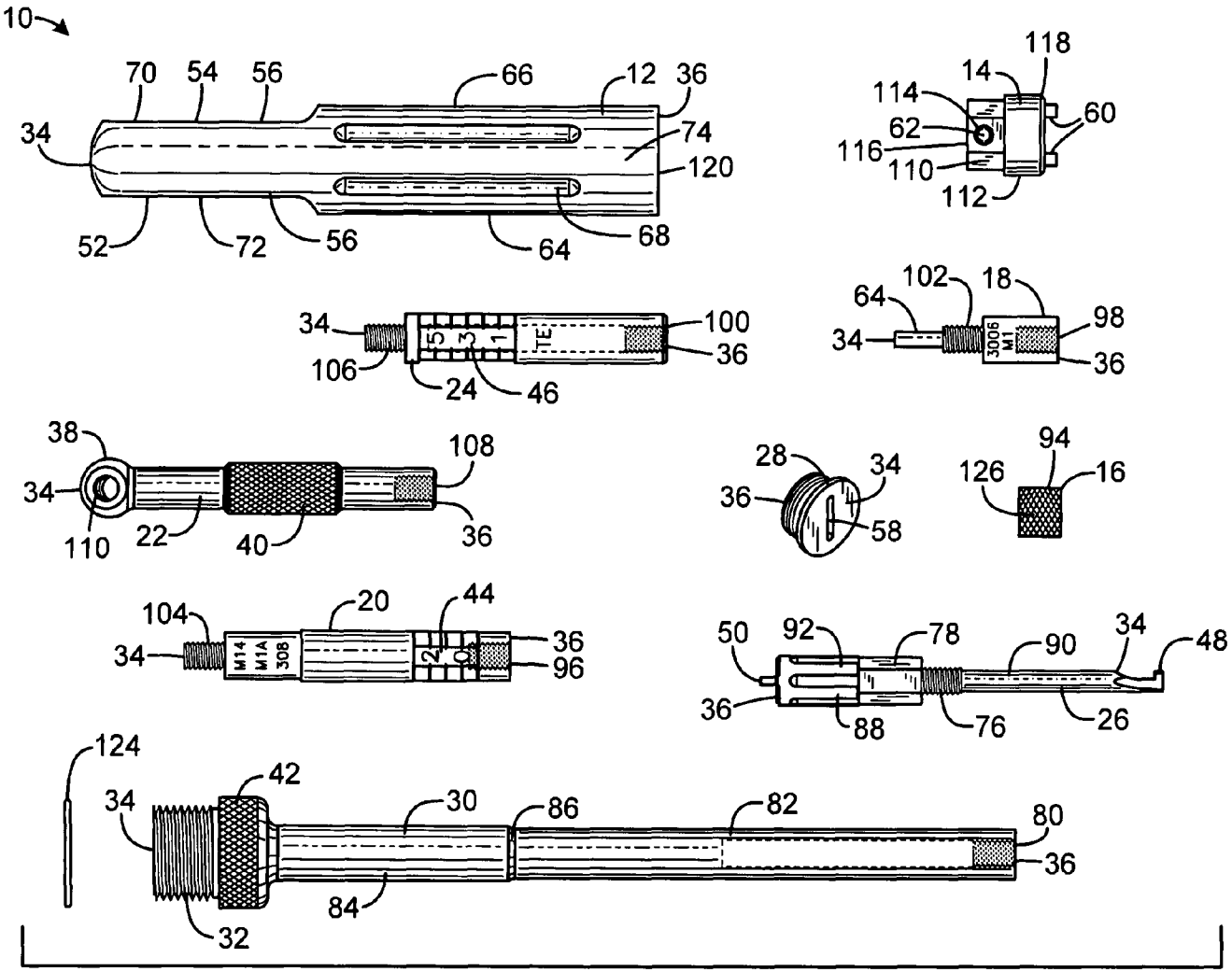
FIG. 1 is a top view of the current embodiment of the multifunction tool kit for firearm maintenance constructed in accordance with the principles of the present invention.

A preferred embodiment of the multifunction tool kit for firearm maintenance of the present invention is shown and generally designated by the reference numeral 10.

FIG. 1 illustrates improved multifunction tool kit 10 of the present invention. More particularly, the toolkit consists of a main tool body 12, a stock liner tool 14, a thread protector 16, a spacer 18, a muzzle wear gauge 20, a handle 22, a throat erosion gauge 24, a multi-stick 26, a grease cap 28, and an alignment gauge 30. These individual tool components of the toolkit both function individually and interconnect with one another in many different configurations to perform a variety of firearm maintenance functions.

Some examples of tools provided by one or a combination of the components of the toolkit include a trigger group take down tool, a .30 caliber muzzle wear gauge, a M14/M1A throat erosion gauge, a M1 Garand throat erosion gauge, a trigger guard take-down tool, an extractor removal tool, a ⅜ inch hex socket wrench, a bolt roller greaser, a ¼ inch hex socket wrench, a gas piston holder, a rear sight tool, a sling swivel tool, a gas valve tool, a magazine floor plate tool, a buttstock trap door tool, a dry storage container, a grease pot, a bolt face carbon scraper, a gas piston groove cleaner, a connector lock pin tool, a rear sight spring/cover tool, a handguard removal tool, a grease cap tool, a flash hider alignment gauge, a stock liner tool, and a gasket sealed dry storage compartment.

The main tool body, alignment gauge, multi-stick, handle, spacer, muzzle wear gauge, throat erosion gauge, and stock liner tool are machined from 41L40 chromoly steel for ease of manufacturing, strength, durability, and the ability to achieve a high Rockwell hardness. The grease cap and thread protector are constructed out of brass. All of the components, except for the grease cap, muzzle wear gauge, and thread protector, are heat treated after machining to a hardness level of 50-52 Rockwell for strength, durability, and wear. The grease cap is made of brass because it is not a high wear part. Furthermore, the softer brass will make a better fit to seal the cap and prevent grease leakage from the grease pot. The muzzle wear gauge is made of 41L40 chromoly steel, but not heat treated, because it contacts the barrel rifling in use. It must be softer than the barrel material so that wear to the barrel is minimized. In addition, not heat treating the part also helps to maintain the highest level of dimensional tolerances as heat treating could cause the gauge to shift dimensionally. The thread protector is made of brass, a softer material than chromoly steel, to protect the threads of the multi-stick but not damage the parts of the rifle.

The toolkit minimizes the amount of material it requires by employing multipurpose tool components that can be arranged in multiple configurations to perform even more functions. This saves weight and bulk compared to traditional toolkits composed of single function tools, which is a huge factor in military applications where weight minimization and portability are critical. No matter how good a toolkit is, if it is too heavy or too bulky to be carried, it inevitably gets left behind. Even for civilian applications, such an approach is convenient by limiting the need for a heavy range bag full of tools when shooting at a gun range.

The characteristics and functionality of each component will first be described individually. Subsequently, examples will be provided of how multiple components can be combined to result in tools having additional capabilities.

Figure 2A:
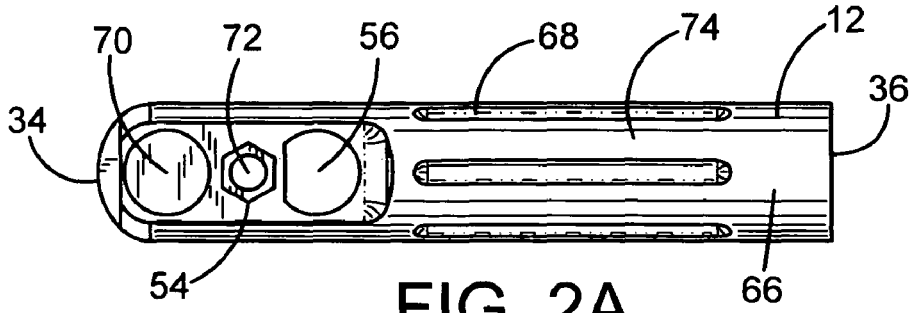
FIG. 2A is a left side view of the current embodiment of the main tool body of the present invention.
Figure 2B:
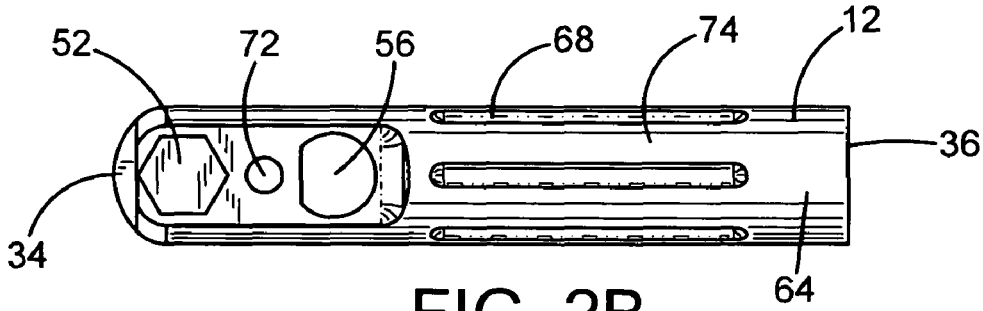
FIG. 2B is a right side view of the current embodiment of the main tool body of the present invention.
Figure 2C:
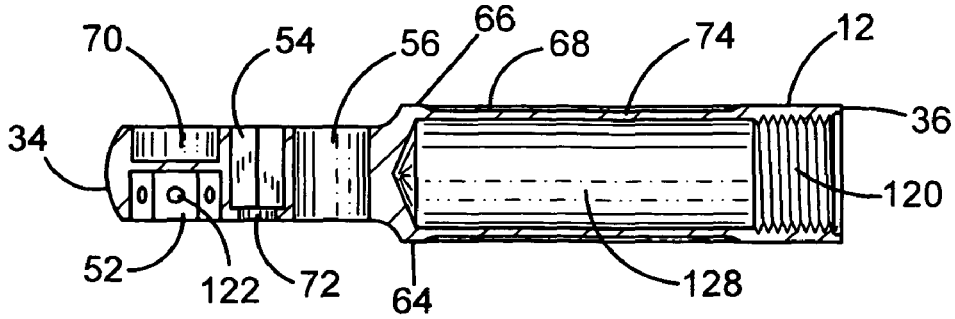
FIG. 2C is a top sectional view of the current embodiment of the main tool body of the present invention.

FIGS. 2A-2C illustrate the main tool body 12 of the present invention. More particularly, the main tool body is generally cylindrical with an aperture 120 in its rear 36 and a closed, rounded front 34. The aperture 120 provides access to a dry storage container 128 within the rear of the main tool body. The threads on the aperture fit threads on the exterior of the grease pot 32 on the front of the alignment gauge 30. A series of recesses 68 are evenly spaced around the outer perimeter 74 of the main tool body to facilitate gripping of the main tool body. The left side 64 and right side 66 of the front of the main tool body are recessed from the outer perimeter of the rear so they have flat exterior surfaces.

The left side of the front of the main tool body has three openings. The front most is a first hex socket 52, the center is an aperture 72, and the rear most is a gas piston holder 56.

The first hex socket is a ⅜ inch hex socket adapted to fit the M14/M1A gas nut plug as well as other ⅜ inch nuts such as scope ring nuts and scope bases. The rear portion of the main tool body acts as a handle to extend leverage to tighten or loosen the gas nut plug. The length of the handle provides adequate leverage for hand tightening the gas nut plug, but it is not long enough that the user can excessively torque and damage the gas nut plug. In this application, the main tool body is designed to be used alone.

The first hex socket has a round indent 122 in each face. Any of the indents can receive the ball plunger 62 on the stock liner tool 14 when its hex portion 110 is inserted into the first hex socket. The indents can also be used to seat retention devices on other attachments having a ⅜ inch nut.

The aperture communicates with the second hex socket 54, but is a round hole that has a smaller diameter than the second hex socket. The aperture is of sufficient diameter to clear the threads on the threaded portion 76 of the multi-stick 26 to prevent contact and damage to them.

The gas piston holder is a "D" shaped hole designed to fit the tail of the M14/M1A gas piston. The piston holder prevents the gas piston from rotating while it is being cleaned. The main tool body acts as a "T" grip handle to extend leverage and act as a counter force. The gas piston holder forms a uniform passageway completely through the main tool body.

The right side of the front of the main tool body also has three openings. The front most is a bolt roller greaser 70, the center is a second hex socket 54, and the rear most is the gas piston holder 56.

The bolt roller greaser is a round, recessed hole designed to fit the M14/M1A bolt roller. The bolt roller greaser does not communicate with the first hex socket. The main tool body acts as a grip handle to maneuver and pack grease into the bolt roller. In this application, the main tool body is designed to be used alone.

The second hex socket is a ¼ inch hex socket designed to receive any standard ¼ inch bit, including the hex portion 78 of the multi-stick 26. The rear portion of the main tool body acts as a "T" grip handle to extend leverage to manipulate the inserted bit.

Figure 3:
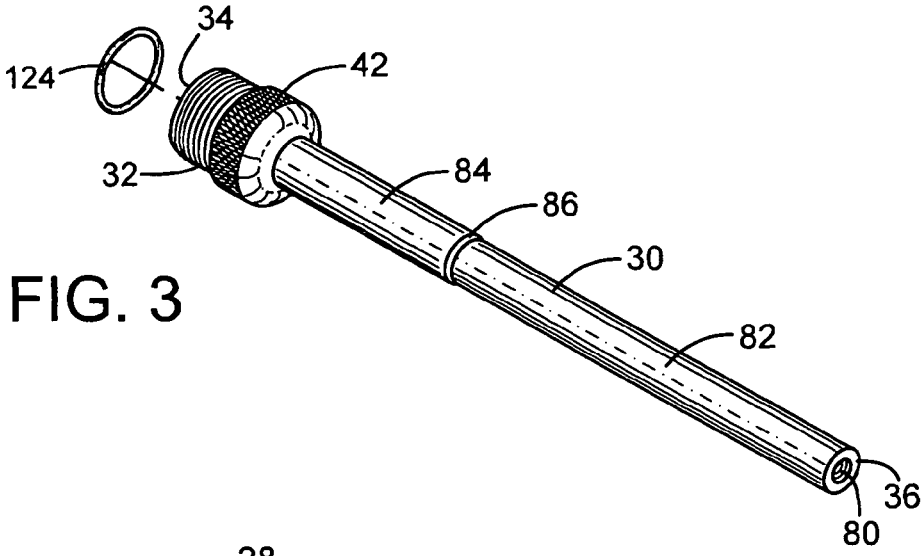
FIG. 3 is a top perspective view of the current embodiment of the alignment gauge of the present invention.

FIG. 3 illustrates the alignment gauge 30 of the present invention. More particularly, the alignment gauge is an elongate rod having a narrow portion 82 at its rear 36 connected to a wide portion 84 at its front 34. The narrow portion has a smaller diameter than the wide portion. The narrow portion is designed so that it is slightly smaller in diameter than the inside bore diameter of a .30 caliber barrel of the M14/M1A rifles. As a result, the alignment gauge will seat straight and align concentrically with the barrel. The wide portion is a bit larger in diameter than a bullet so that the clearance between the wide portion and the inner walls of the muzzle device can be checked. A tapered step 86 is present where they are joined.

The rear of the narrow portion has a threaded aperture 80. The threaded aperture 80 is threaded to receive the front of the throat erosion gauge.

The front of the wide portion is connected to a grease pot 32. The rear of the grease pot forms a knurled surface 42 to facilitate the user's grip when attaching the alignment gauge to another component. The front of the grease pot has interior threads that receive the grease cap 28. The grease pot contains sufficient grease to completely lubricate a firearm at least once and keeps the grease separate from the other components of the tool kit. A sealing gasket 124 fits around the base of the exterior threads on the grease pot adjacent to the knurled surface 42.

Figure 4:
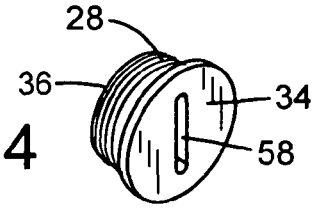
FIG. 4 is a top perspective view of the current embodiment of the grease cap of the present invention.

FIG. 4 illustrates the grease cap 28 of the present invention. More particularly, the rear 36 of the grease cap is threaded for attachment to the grease pot 32. The front of the grease cap has a slot 58 therein. The slot is adapted to receive the screwdriver 50 protruding from the rear of the multi-stick to facilitate attachment and removal of the grease cap from the grease pot.

Figure 5:
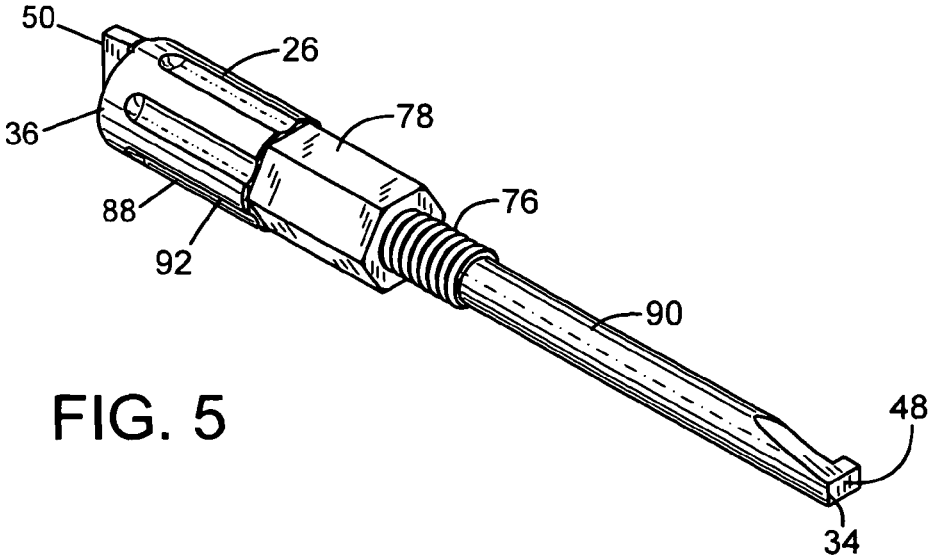
FIG. 5 is a top perspective view of the current embodiment of the multi-stick of the present invention.

FIG. 5 illustrates the multi-stick 26 of the present invention. More particularly, the multi-stick has an elongate rod 90 that terminates in a tapered, hooked tip 48 at its front 34. The multi-stick has a handle 88 connected to the rear 36 of the rod. The handle forms a grip 92 with its rear most portion. A series of recesses are evenly spaced around the outer perimeter of the grip 92 to facilitate gripping of the handle. A straight blade screwdriver 50 protrudes from the rear of the grip. A hex portion 78 is connected to the front of the grip. The hex portion is a standard ¼ inch bit receivable by the second hex socket 54 in the main tool body 12. The rear most portion of the rod forms a threaded portion 76 where it connects to the front of the hex portion. The threaded portion is adapted to be threadedly inserted into the threaded aperture 94 in the thread protector 16 and into the threaded aperture 100 in the throat erosion gauge 24. It can also fit into the threaded end 80 of the alignment gauge 30.

Figure 6:
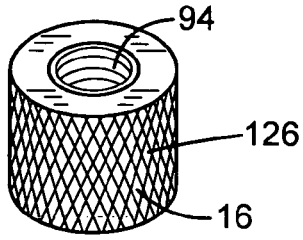
FIG. 6 is a top perspective view of the current embodiment of the thread protector of the present invention.

FIG. 6 illustrates the thread protector 16 of the present invention. More particularly, the thread protector 16 is cylindrical in shape with a central threaded aperture 94 that is adapted to threadedly receive the threaded portion 76 of the multi-stick 26. The thread protector has a knurled surface 126 that facilitates gripping of the thread protector. The thread protector is installed on the multi-stick 26 to protect the multi-stick's threaded portion during certain tasks that will be described subsequently.

Figure 7:
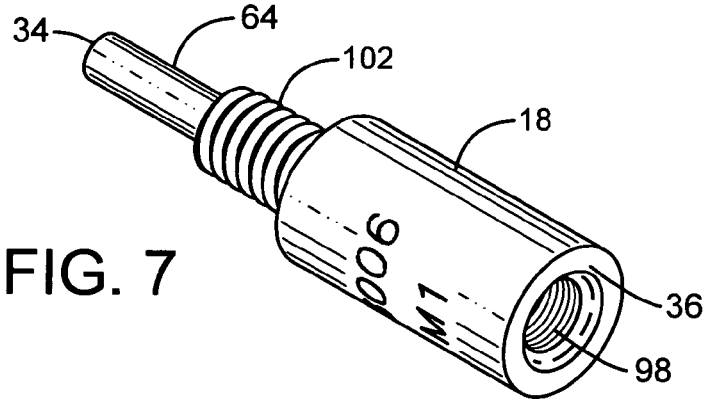
FIG. 7 is a top perspective view of the current embodiment of the spacer of the present invention.

FIG. 7 illustrates the spacer 18 of the present invention. More particularly, the spacer is generally cylindrical in shape with a threaded rear aperture 98. The rear aperture is adapted to threadedly receive the threaded portion 104 of the muzzle wear gauge 20. The front 34 of the spacer has a threaded portion 102. The threaded portion is adapted to be threadedly received by the aperture 100 in the throat erosion gauge 24. The front most portion of the spacer is a pin punch 64. The pin punch 64 is straight so that it cannot become stuck in a rifle component in use.

Figure 8:
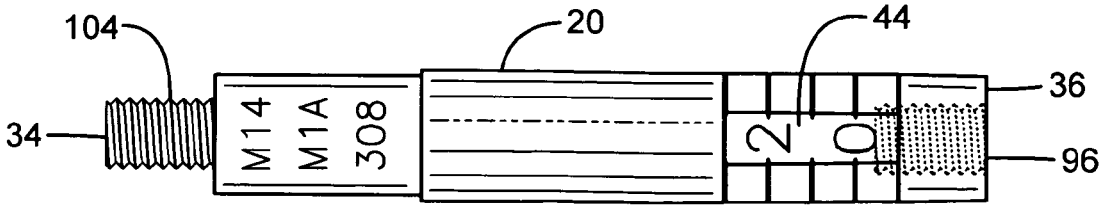
FIG. 8 is a top view of the current embodiment of the muzzle wear gauge of the present invention.
Figure 9:
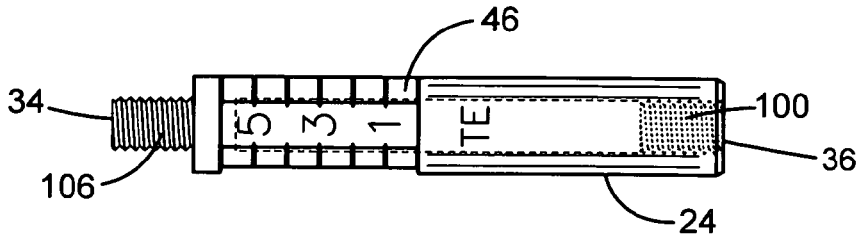
FIG. 9 is a top view of the current embodiment of the throat erosion gauge of the present invention.

FIG. 8 illustrates the muzzle wear gauge 20 of the present invention. More particularly, the muzzle wear gauge is generally cylindrical in shape with a threaded rear aperture 96. The rear aperture is adapted to receive the pin punch 64 and to threadedly receive the threaded portion 102 of the spacer 18. The front 34 of the muzzle wear gauge has a threaded portion 104. The threaded portion is adapted to be threadedly received by the apertures 108 and 110 in the handle 22. The muzzle wear gauge has a series of markings 44 on its exterior on one side whose purpose will be described subsequently FIG. 9 illustrates the throat erosion gauge 24 of the present invention. More particularly, the throat erosion gauge is generally cylindrical in shape with a threaded rear aperture 100. The rear aperture is adapted to threadedly receive the threaded portion 76 of the multi-stick 26. The front 34 of the throat erosion gauge has a threaded portion 106. The threaded portion is adapted to be threadedly received by the aperture 98 in the spacer 18. The throat erosion gauge has a series of markings 46 on its exterior on two sides whose purpose will be described subsequently.

Figure 10:
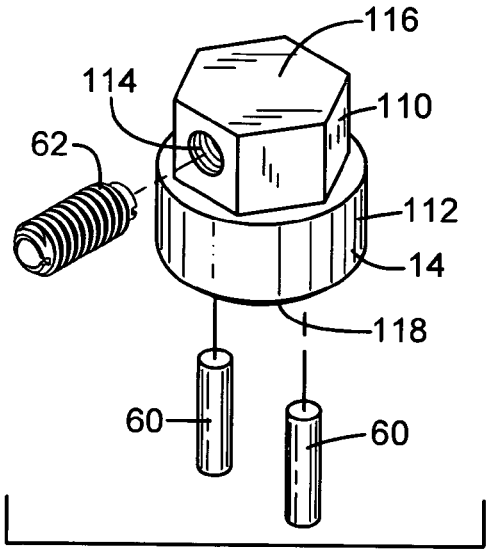
FIG. 10 is a top perspective exploded view of the current embodiment of the stock liner tool of the present invention.

FIG. 10 illustrates the stock liner tool 14 of the present invention. More particularly, the stock liner tool has a top 116 and a bottom 118. The bottom forms a cylindrical portion 112 that receives dual prong points 60. The top forms a hex portion 110 with an aperture 114 in two faces. The aperture 114 receives a ball plunger 62. The aperture is drilled through the hex portion so an Allen wrench can be inserted from other side to back out the ball spring. The hex portion is a ⅜ inch hex bit adapted to fit the first hex socket 52 in the main tool body 12.

Figure 11:
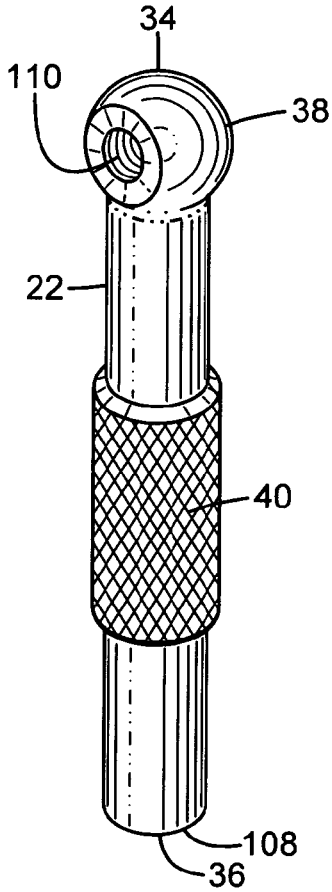
FIG. 11 is a top perspective view of the current embodiment of the handle of the present invention.

FIG. 11 illustrates the handle 22 of the present invention. More particularly, the handle 22 is an elongate rod terminating in a ball tip 38 at its front 34. The rear 36 of the handle has a threaded aperture 108. The middle of the handle is a knurled surface 40 that facilitates gripping of the handle. The ball tip has a threaded aperture 110 in its center that does not break through the ball tip.

On its own, the handle functions as a trigger guard takedown tool. The narrow rear end of the handle is designed to be inserted into the M14/M1A Trigger Guard Hole to unlock the trigger guard/action. This is the first step in the disassembly of the rifle. Depending on the fit of the action and the stock, the trigger guard can be extremely tight, making it difficult to unlock. The handle gives the user extra leverage over the trigger guard. The rounded ball tip on one end of the tool is also comfortable in the palm of the hand as the user applies pressure because it eliminates the discomfort of sharp corners.

Figure 12A:
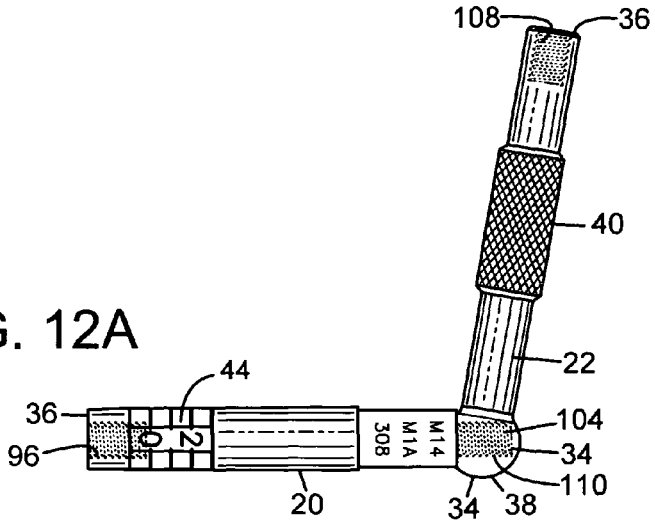
FIG. 12A is a top view of the current embodiment of the muzzle wear gauge attached at an angle to the handle of the present invention.
Figure 12B:
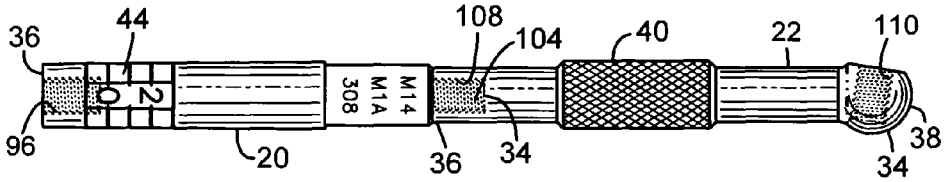
FIG. 12B is a top view of the current embodiment of the muzzle wear gauge attached straight on to the handle of the present invention.

FIGS. 12A and 12B illustrate the muzzle wear gauge 20 connected to the handle 22 of the present invention to form a .30 muzzle wear gauge tool. More particularly, in FIG. 12A, the handle is connected to the wear gauge at an angle, and in FIG. 12B, the handle is connected to the wear gauge straight on. The user can choose either attachment method based on his or her preference.

When the handle is connected to the muzzle wear gauge at an angle, the threaded portion 104 of the muzzle wear gauge is inserted into the aperture 110 in the ball tip 34 to form an angled handle. When the handle is connected to the muzzle wear gauge straight on, the threaded portion 104 of the muzzle wear gauge is inserted into the aperture 108 in the rear 36 of the handle to form a straight handle.

The muzzle wear gauge is precision machined and tapered to fit the muzzle of any .30 caliber barrel. The number markings 44 on the muzzle wear gauge enable the user to determine the relative wear condition of the barrel rifling by using the tool.

Figure 13:
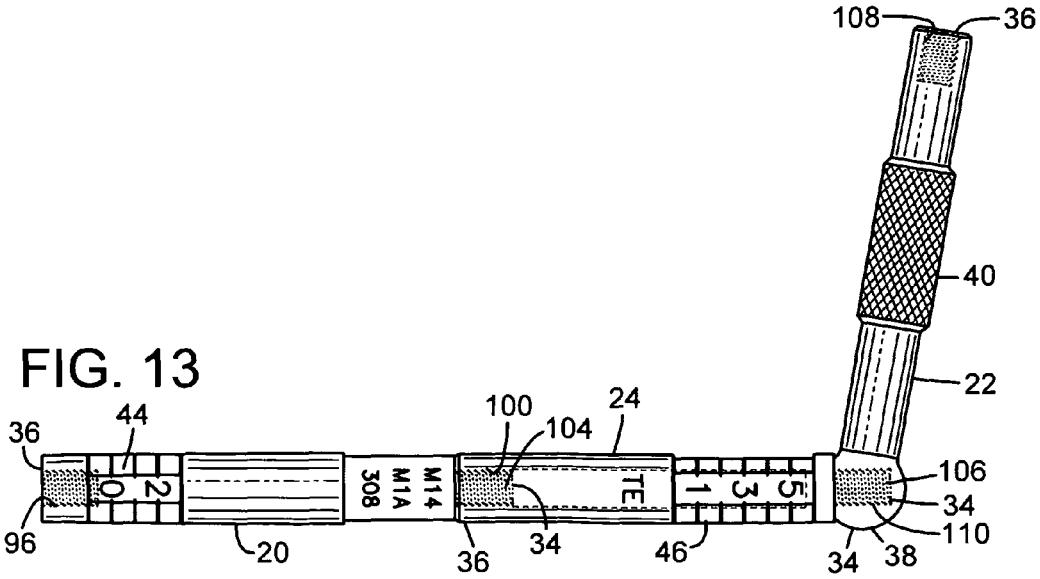
FIG. 13 is a top view of the current embodiment of the throat erosion gauge attached to the handle and muzzle wear gauge of the present invention.

FIG. 13 illustrates the throat erosion gauge 24 attached to the handle 22 and muzzle wear gauge 20 of the present invention to form an M14/M1A throat erosion gauge tool. More particularly, the threaded portion 106 of the throat erosion gauge is inserted into the aperture 110 in the ball tip 34 to form an angled handle. The threaded portion 104 of the muzzle wear gauge is then inserted into the aperture 100 in the throat erosion gauge to form the complete tool.

The muzzle wear gauge is precision machined and tapered to fit into the chamber end of the M14/M1A barrel. The markings on the throat erosion gauge as it aligns with the top edge of the rifle's receiver indicate the relative throat erosion wear condition of the barrel. The overall length of the tool is designed to clear and fit into the action with the op-rod locked back and while the bolt is held by the bolt-stop.

Figure 14:
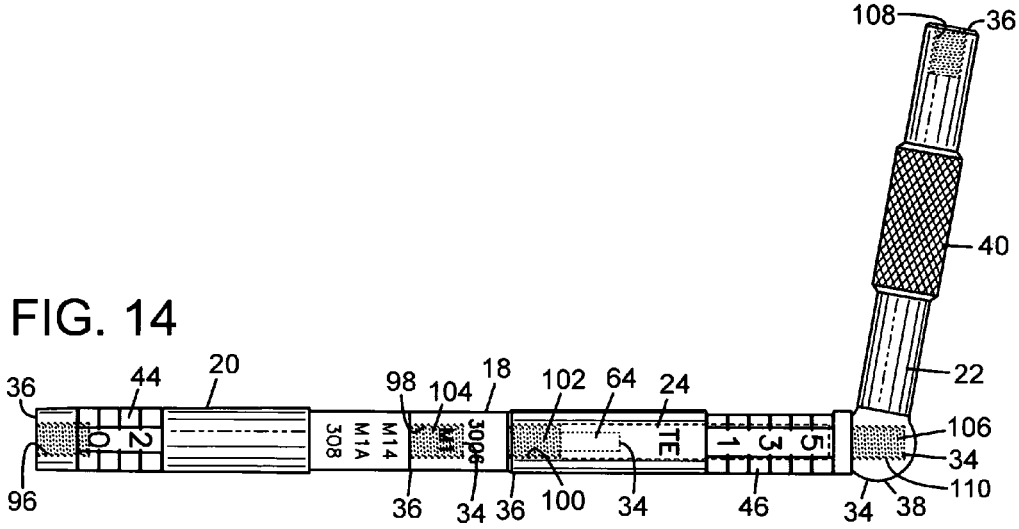
FIG. 14 is a top view of the current embodiment of the throat erosion gauge attached to the handle, spacer, and muzzle wear gauge of the present invention.

FIG. 14 illustrates the throat erosion gauge 24 attached to the handle 22, spacer 18, and muzzle wear gauge 20 of the present invention to form an M1 Garand throat erosion gauge tool. More particularly, the threaded portion 106 of the throat erosion gauge is inserted into the aperture 110 in the ball tip 34 to form an angled handle. The threaded portion 102 of the spacer is then inserted into the aperture 100 in the throat erosion gauge. Finally, the threaded portion 104 of the muzzle wear gauge is inserted into the aperture 98 of the spacer to form the complete tool.

The muzzle wear gauge is precision machined and tapered to fit into the chamber end of the M1 Garand barrel. The markings on the throat erosion gauge as it aligns with the top edge of the rifle's receiver indicate the relative throat erosion wear condition of the barrel. The overall length of the tool is designed to clear and fit into the action with the op-rod locked back and while the bolt is held by the bolt-stop.

Figure 15:
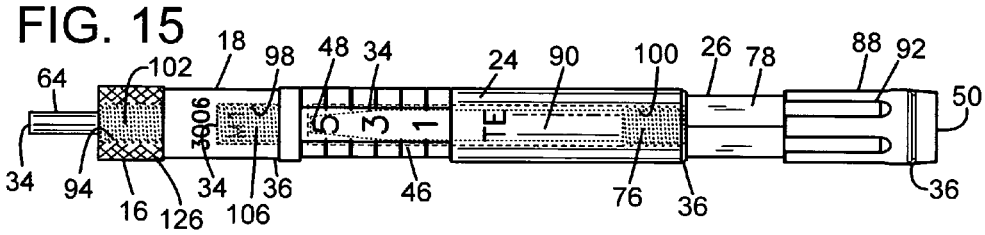
FIG. 15 is a top view of the current embodiment of the thread protector and spacer attached to the throat erosion gauge and multi-stick of the present invention.

FIG. 15 illustrates the thread protector 16 and the spacer 18 attached to the throat erosion gauge 24 and multi-stick 26 of the present invention to form a trigger group takedown tool and an extractor removal push tool. More particularly, the threaded portion 102 of the spacer is inserted into the aperture 94 in the thread protector 16. Then, the threaded portion 106 of the throat erosion gauge is inserted into the aperture 98 in the spacer. Finally, the threaded portion 76 of the multi-stick is inserted into the aperture 100 of the throat erosion gauge to form the complete tools.

The pin punch 64 on the front 34 of the spacer is a precision pin punch designed to fit and press out the pins in the trigger group as well as to push out the extractor leg from the underside of the bolt. The pin punch enables this combination of components to function as both a trigger group takedown tool and an extractor removal push tool. The extra length achieved by combining the spacer with the throat erosion gauge and multi-stick components provides the user with a larger area to grip and leverage for manipulating the pin punch.

An optional feature is an additional section added to the pin punch end of the trigger group take down configuration. This approximately 2 inches long section includes a ball point pen with a short ink tube. The section can be screwed onto the tool to provide a full size writing pen in the field.

Figure 16:
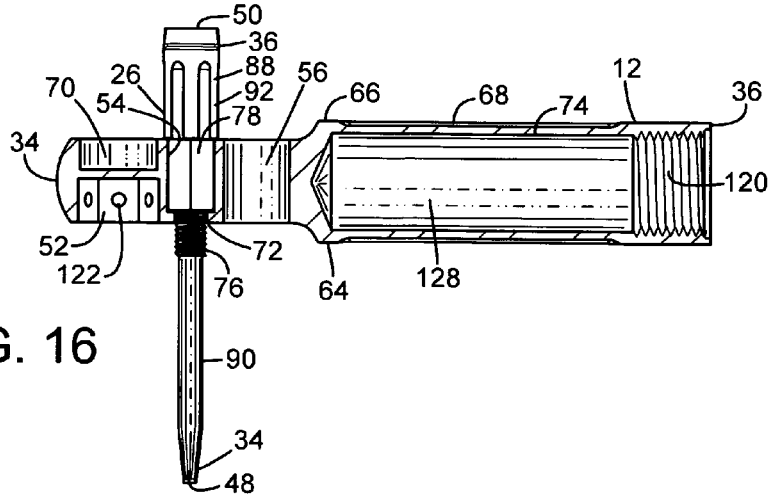
FIG. 16 is a top sectional view of the current embodiment of the multi-stick attached to the main tool body of the present invention.

FIG. 16 illustrates the multi-stick 26 attached to the main tool body 12 of the present invention to form a M14/M1 rear sight screwdriver with torque handle tool, a large flat head screwdriver tool, a magazine floor plate removal tool, and a M14/M1A/M1 Garand trap door tool. More particularly, the threaded portion 76 of the multi-stick is inserted through the second hex socket 54 and into the aperture 72 of the main tool body with the hex portion 78 being received by the second hex socket to form the complete tools.

So it can be used as a M14/M1 rear sight screwdriver with torque handle tool, the screwdriver 50 protruding from the rear 36 of the multi-stick is designed to fit the dimensions of the rifles' rear sight screws. The hex portion fits the second hex socket so that the main tool body can be used as a handle to exert additional leverage and torque to loosen and tighten the rear sight screws.

The screwdriver 50 is also designed to fit the buttstock screws of the M14/M1A/M1 Garand rifles, enabling this combination of components to serve as a large flat head screwdriver tool. The tool can be used to loosen and tighten those screws, as well as the M1 Garand front sling swivel screw and stacking swivel screw. In addition, the tool can be used as a screwdriver to depress the gas cylinder valve and then rotate it to the open or closed position.

The hooked tip 48 of the multi-stick enables this combination of components to also be used as a magazine floor plate removal tool. The main tool body is used as a handle to exert additional leverage and provide added comfort to the hand as the flat hooked tip extending from the front of the rod 90 is used as a pulling tool. The hooked tip is inserted into the magazine floor plate hole and grabs hold of the floor plate. Once the magazine floor plate is lifted up to clear the edges of the magazine body, the tool is used to pull and slide the magazine floor plate out the side to begin the magazine disassembly process. The "T" configuration resulting from the main tool body when it is connected to the multi-stick enables the user to exert sufficient leverage to pull off the magazine floor plate. Typically, a tool as small as the multi-stick does not provide enough leverage to accomplish this function.

Finally, the hooked tip 48 of the multi-stick also enables this combination of components to function as a M14/M1A/M1 Garand trap door tool. The main tool body is used as a handle to exert additional leverage and provide added comfort to the hand as the flat hooked tip extending from the front of the rod 90 is used as a tool to open the trap door on the M14/M1A and M1 Garand stocks. The hooked tip pulls on the lip on the M1 Garand trap door or decompresses the plunger on the M14/M1A trap door.

Figure 17:
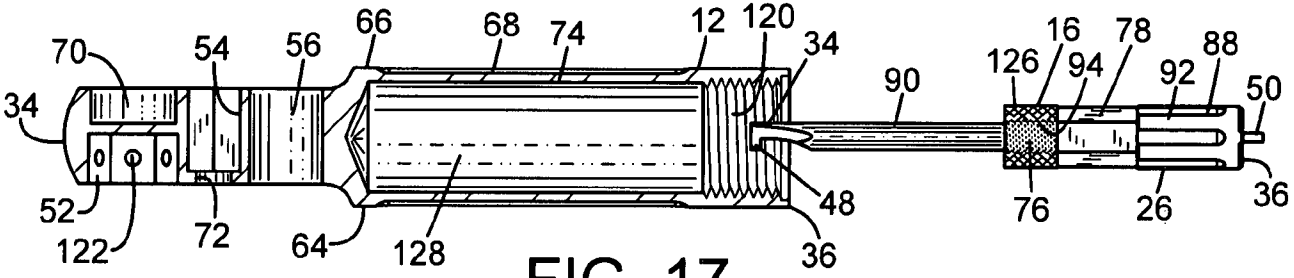
FIG. 17 is a top sectional view of the current embodiment of the multi-stick with the thread protector attached inserted into the main tool body of the present invention.
Figure 18:
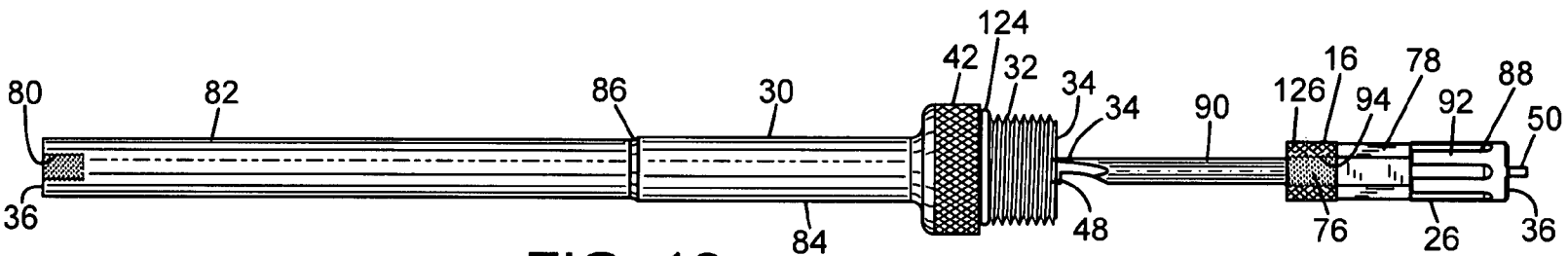
FIG. 18 is a top view of the current embodiment of the multi-stick inserted into the grease pot end of the alignment gauge of the present invention.

FIGS. 17 and 18 illustrate the multi-stick 26 of the present invention being used as a grease stick. In FIG. 17, the dry storage container 118 in the main tool body 12 is used for grease storage. In this case, the rod 90 is inserted through the aperture 120 to access the dry storage container. In FIG. 18, grease is stored in the grease pot 32 that is connected to the alignment gauge 30. In this case, the rod 90 is inserted into the grease pot 32 once the grease cap 28 has been removed. In both cases, the thread protector 16 is first applied to the threaded portion 76 of the multi-stick to protect the threads. The multi-stick can also be used as a grease applicator.

Figure 19:
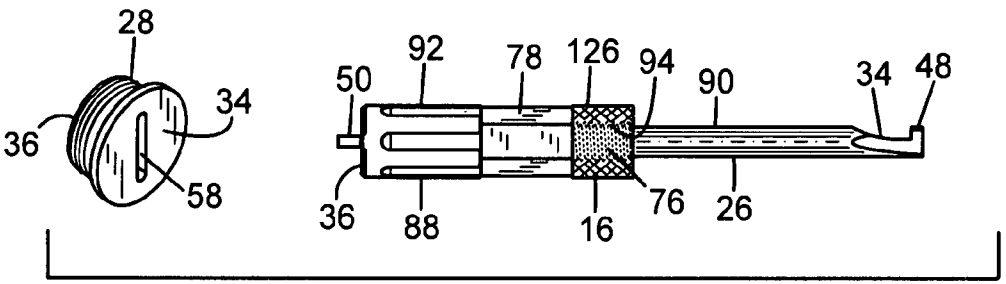
FIG. 19 is a top exploded view of the current embodiment of the multi-stick engaged with the grease cap of the present invention.

FIG. 19 illustrates the multi-stick 26 of the present invention configured for use as a grease cap tool, bolt face carbon scraper, gas piston groove cleaner, connector lock pin tool, rear sight spring/cover tool, and a firearm extractor claw scraper with or without the extractor claw being removed from the bolt. In all of these applications, the thread protector 16 is first applied to the threaded portion 76 of the multi-stick to protect the threads.

This combination of components can be used as a grease cap tool to tighten or loosen the grease cap 28 on the grease pot 32. To perform this function, the screwdriver 50 on the multi-stick is inserted into the horizontal slot 58 on the grease cap.

This combination of components can also serve as a bolt face carbon scraper. In this application, the flat hooked tip 48 extending from the rod 90 of the multi-stick is used as a scraper on the bolt face to remove excess carbon, primer sealant, and other foreign deposits.

This combination of components also functions as a gas piston groove cleaner. The hooked tip 48 extending from the rod 90 of the multi-stick receives a cleaning patch. The resulting cleaning tool is used to remove carbon deposits from between the gas piston grooves. The thickness of the hooked tip is designed to fit the piston grooves. This tool can be used in conjunction with the main tool body 12 serving as a gas piston holder.

This arrangement of components can be utilized as a connector lock pin tool. In this application, the flat hooked tip 48 extending from the rod 90 of the multi-stick is used to push/pry on the connector lock pin to push the connector lock open. Once the connector lock is open, the op-rod spring guide can be removed.

This arrangement of components can also be used as a rear sight spring/cover tool. In this application, the flat hooked tip 48 extending from the rod 90 of the multi-stick is used to push/pry on the rear sight spring/cover to achieve their removal.

Finally, this combination of components can also be used as a firearm extractor claw scraper with or without the extractor claw being removed from the bolt. In this application, the flat hooked tip 48 extending from the rod 90 of the multi-stick is used as a scraper on the extractor claw to remove excess carbon, primer sealant, and other foreign deposits.

Figure 20:
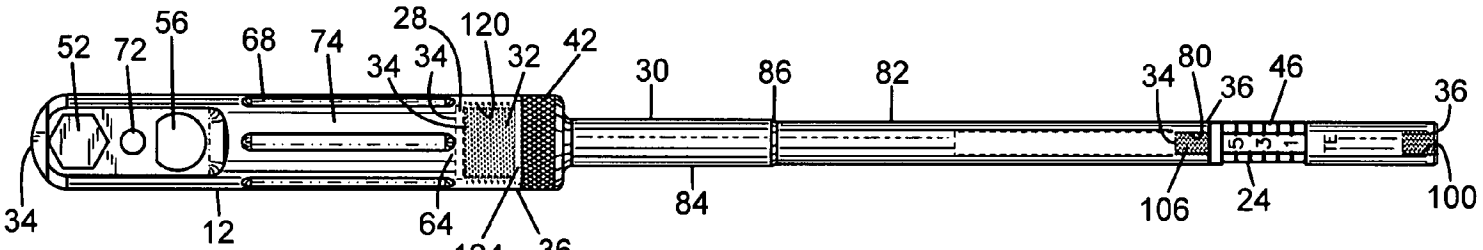
FIG. 20 is a right side view of the current embodiment of the throat erosion gauge and alignment gauge attached to the main tool body of the present invention.

FIG. 20 illustrates the main tool body 12 attached to the alignment gauge 30 and the throat erosion gauge 24 of the present invention to form a flash hider alignment gauge. The grease pot 32 end of the alignment gauge is inserted into the aperture 120 in the rear of the main tool body, and the threaded portion 106 of the throat erosion gauge is threadedly connected to the aperture 80 in the rear of the alignment gauge. In use, the throat erosion gauge is inserted into the muzzle end of the barrel through the flash hider or other muzzle devices, such as muzzle brakes and flash suppressors. The tight fit between the throat erosion gauge and the inner walls or rifling of the barrel keeps the tool aligned and concentric with the barrel. The additional length provided by the throat erosion gauge adds further accuracy to the alignment. The secondary step up in diameter section 84 of the alignment gauge is the portion that is within the flash hider or muzzle device. It is used to check for clearance and contact with the inner surfaces of the flash hider or muzzle device to ensure that it is in perfect alignment with the barrel. This prevents any bullet strikes. The length of this intermediate section of the alignment gauge inside the flash hider or muzzle device is designed so that it does not bottom out against the crown of the muzzle when used on a muzzle device shorter than the standard United States Government Issue (USGI) M14 flash hider. This tool is designed to clear the majority of the popular muzzle devices on the market today, which is a significant improvement over the original USGI alignment gauge.

The original GI flash hider is long, so the original USGI alignment gauge is also long. However, there are many muzzle devices currently in use that are shorter than the original GI flash hider. The larger diameter section 84 of the alignment gauge 30 is shorter, so the step 86 that occurs between the larger diameter section 84 and the smaller diameter section 82 does not bottom out and hit the crown of the barrel and potentially damage it. As a result, the alignment gauge 30 will work with a much greater variety of muzzle attachments then the original USGI alignment gauge.

Figure 21:
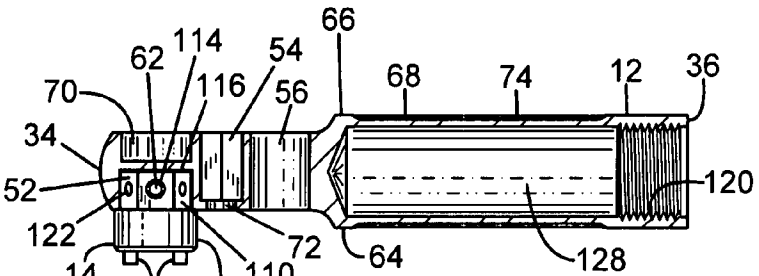
FIG. 21 is a top sectional view of the current embodiment of the stock liner tool attached to the main tool body of the present invention.

FIG. 21 illustrates the main tool body 12 attached to the stock liner tool 14 of the present invention to form a stock liner tool with torque handle. The hex portion 110 of the stock liner tool is received by the first hex socket 52 in the main tool body. The ball plunger 62 snaps into small round indents 122 inside the first hex socket to retain the hex portion within the first hex socket. In use, the dual prong points 60 fit into the stock liner screws. The main tool body is used to provide leverage for unscrewing or tightening the stock liner screws, but the main tool body is short enough to prevent over tightening of the stock liner screws.

Figure 22:
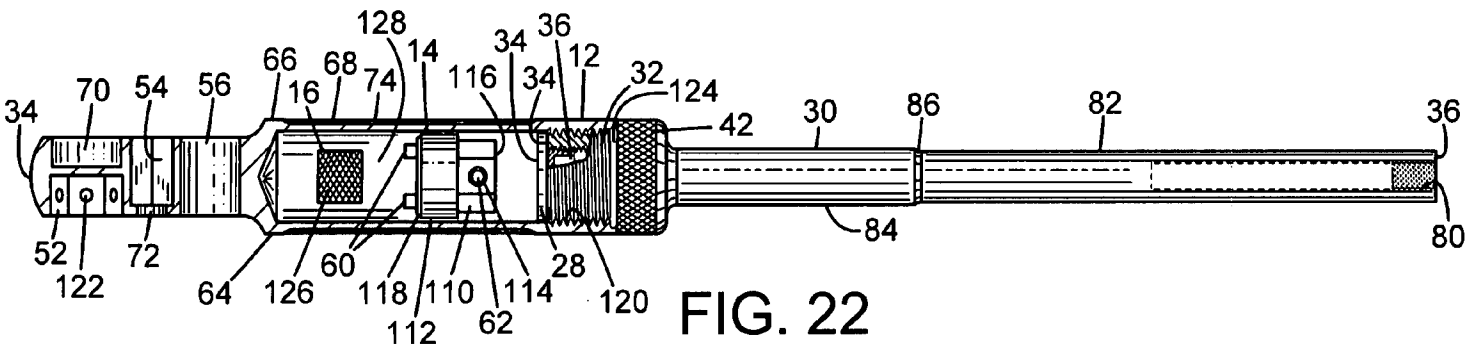
FIG. 22 is a top sectional view of the current embodiment of the alignment gauge securing the thread protector and stock liner tool within the main tool body of the present invention.

FIG. 22 illustrates the main tool body 12 attached to the alignment gauge 30 of the present invention to form a watertight storage container. First, the grease cap 28 is connected to the grease pot 32. Subsequently, the grease cap is inserted into the aperture 120 in the rear of the main tool body. A sealing gasket 124 positioned between the grease cap and the main tool body results in the dry storage container 128 being watertight. The storage container can be used to store the thread protector 16 and stock liner tool 14 when they are not in use. It can also be used to store other items, such as a DL1/3N battery, a size N battery, an extractor, an extractor spring and plunger, a trigger pin, and/or a bore patch. Further examples of items that can be stored, which should not be viewed as limiting, are a castle nut set screw, a front sight screw, a wet match, and money. The grease cap can also be left off the alignment gauge to enable the user to store a longer item in the dry storage tube, like the M14 ejector and ejector spring.

Figure 23A:
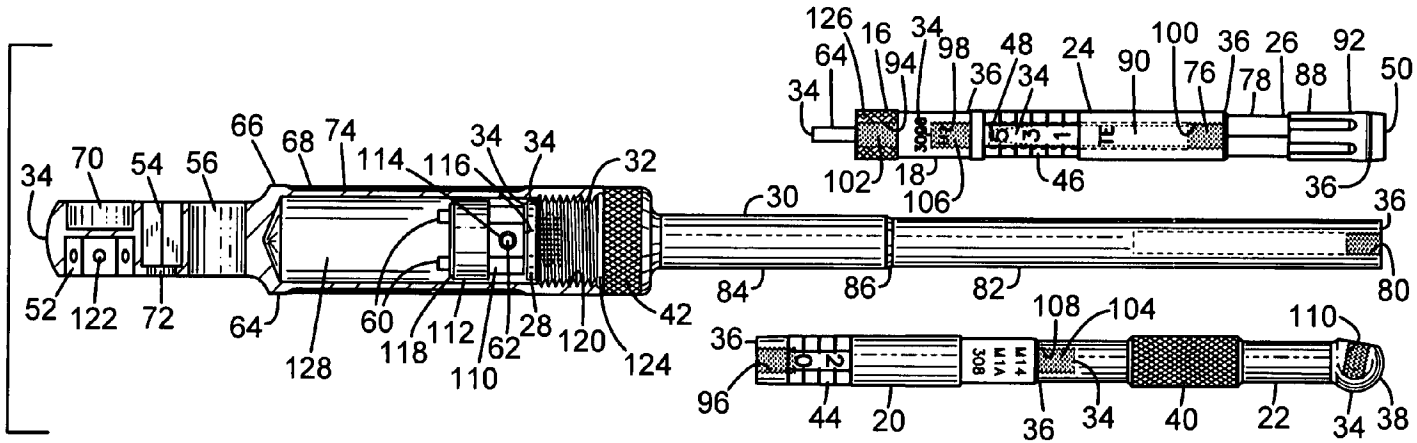
FIG. 23A is a top sectional view of the current embodiment of the multifunction tool kit for firearm maintenance configured for M14/M1A buttstock storage.
Figure 23B:
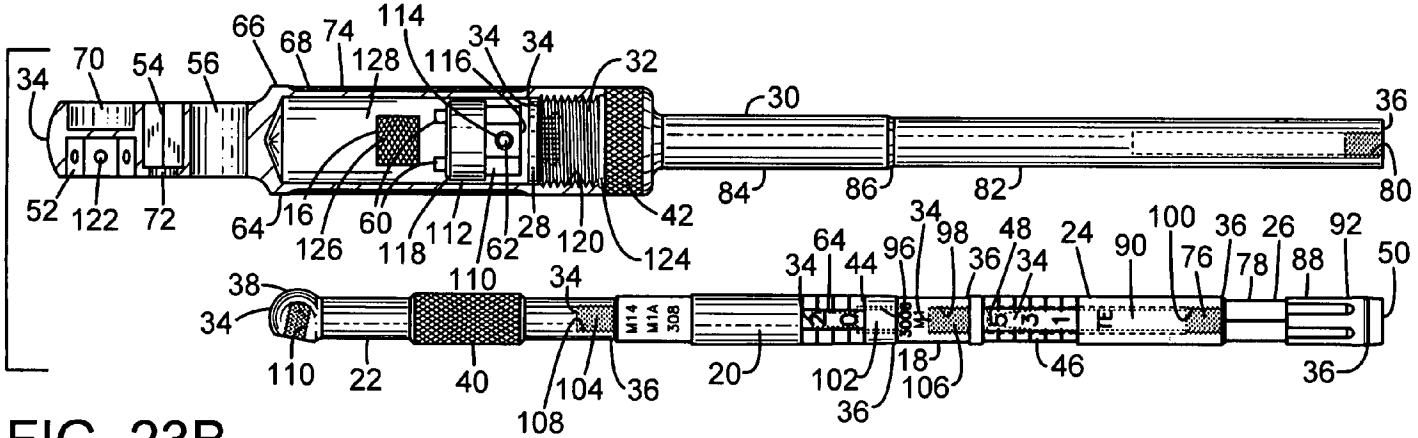
FIG. 23B is a top sectional view of the current embodiment of the multifunction tool kit for firearm maintenance configured for tool pouch storage.

FIGS. 23A and 23B illustrate two storage configurations of the present invention. More particularly, in FIG. 23A, the multifunction tool kit for firearm maintenance is depicted in its M14/M1A buttstock storage configuration, and in FIG. 23B, the multifunction tool kit for firearm maintenance is depicted in its tool pouch storage configuration. The user can choose either storage configuration based on his or her preference.

In its M14/M1A buttstock storage configuration, the components of the present invention are assembled into three sections in the following order. In the first section, the thread protector 16 is threadedly attached to the threaded portion 102 of the spacer 18, the threaded portion 106 of the throat erosion gauge 24 is threadedly attached to the aperture 98 in the rear of the spacer, and the threaded portion 76 of the multi-stick 26 is threadedly attached to the aperture 100 in the rear of the throat erosion gauge. In the second section, the threaded portion 104 of the muzzle wear gauge 20 is threadedly attached to the aperture 108 in the rear of the handle 22. In the third section, the grease cap 28 is attached to the grease pot 32 portion of the alignment gauge 30, and the grease cap 28 is inserted into the aperture 120 in the rear of the main tool body 12 with the stock liner tool 14 already inside the dry storage container 128. The three sections are designed to fit a cylindrical tube 0.80 inches in diameter by 9" long. Since the USGI specification for the long buttstock hole of the M14/M1A stock is 0.802 inches in diameter by 9.32 inches long, the three sections are readily received by the long buttstock hole.

In its tool pouch storage configuration, the components of the present invention are assembled into two sections in the following order. In the first section, the threaded portion 104 of the muzzle wear gauge 20 is threadedly attached to the aperture 108 in the rear of the handle 22, the threaded portion 102 of the spacer 18 is threadedly attached to the aperture 96 in the rear of the muzzle wear gauge, the threaded portion 106 of the throat erosion gauge 24 is threadedly attached to the aperture 98 in the rear of the spacer, and the threaded portion 76 of the multi-stick 26 is threadedly attached to the aperture 100 in the rear of the throat erosion gauge. In the second section, the grease cap 28 is attached to the grease pot 32 portion of the alignment gauge 30, and the grease cap 28 is inserted into the aperture 120 in the rear of the main tool body 12 with the stock liner tool 14 and the thread protector 16 already inside the dry storage container 128.

While a current embodiment of the multifunction tool kit for firearm maintenance has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A multifunction tool kit for firearm maintenance comprising:

a main tool body;

the main tool body having at least a first attachment facility;

a first tool component having opposing ends and an attachment facility adapted to removably connect to the first attachment facility on the main tool body;

at least one of the opposing ends of the first tool component terminates in a feature adapted to fit one or more components on a firearm;

a feature on an opposing end of the first tool component is exposed and extends outwards from the opposing sides of the main tool body when the first tool component is connected to the main tool body;

the first tool component being operable to perform at least one of the functions selected from the group comprising:

turning a firearm's rear sight screws, turning a firearm's buttstock screws, turning a firearm's front sling swivel screw, turning a firearm's stacking swivel screw, depressing and rotating a firearm's gas cylinder valve, removing a firearm's magazine floor plate, and opening a firearm's trapdoor when connected to the main tool body; and a plurality of cylindrical tool components having a male threaded attachment facility and a female threaded attachment facility;

one of the female attachment facilities on one of the cylindrical tool components being adapted to connect to the attachment facility on the first tool component.

2. The tool kit of claim 1, further comprising:

the main tool body having a second attachment facility;

a second tool component;

the second tool component having an attachment facility adapted to removably connect to the main tool body's second attachment facility;

the second tool component being operable to turn a firearm's stock liner screws when connected to the main tool body.

3. The tool kit of claim 2, further comprising:

the main tool body defining an elongated bore; and the second tool component fitting within the bore for storage.

4. The tool kit of claim 1, further comprising:

a third tool component; and the third tool component having an attachment facility adapted to removably cover a portion of the first tool component's attachment facility.

5. The tool kit of claim 1 further comprising at least one of the cylindrical tool components having exterior markings selected from the group comprising:

markings operable to indicate the relative throat erosion wear condition of a firearm's gun barrel, and markings operable to indicate the relative wear condition of a gun barrel's rifling.

6. The tool kit of claim 1 further comprising at least one of the cylindrical tool components having a pin punch extending therefrom.

7. A multifunction tool kit for firearm maintenance comprising:

a main tool body;

the main tool body having at least a first attachment facility;

a first tool component having opposing ends and an attachment facility adapted to removably connect to the first attachment facility on the main tool body;

at least one of the opposing ends of the first tool component terminates in a feature adapted to fit one or more components on a firearm;

a feature on an opposing end of the first tool component is exposed and extends outwards from the opposing sides of the main tool body when the first tool component is connected to the main tool body;

the first tool component being operable to perform at least one of the functions selected from the group comprising:

turning a firearm's rear sight screws, turning a firearm's buttstock screws, turning a firearm's front sling swivel screw, turning a firearm's stacking swivel screw, depressing and rotating a firearm's gas cylinder valve, removing a firearm's magazine floor plate, and opening a firearm's trapdoor when connected to the main tool body;

the main tool body having a second attachment facility;

a second tool component;

the second tool component having an attachment facility adapted to removably connected to the main tool body's second attachment facility;

the second tool component being operable to turn a firearm's stock liner screws when connected to the main tool body;

the main tool body defining an elongated bore;

the second tool component fitting within the bore for storage;

the tool kit further comprising:

a fourth tool component;

the fourth tool component having an attachment facility adapted to removably connect to the elongated bore in the main tool body;

the fourth tool component forming a watertight storage container within the main tool body tool component when connected to the main tool body with a sealing gasket.

8. A multifunction tool kit for firearm maintenance comprising:

a main tool body;

the main tool body having at least a first attachment facility;

a first tool component having opposing ends and an attachment facility adapted to removably connect to the first attachment facility on the main tool body;

at least one of the opposing ends of the first tool component terminates in a feature adapted to fit one or more components on a firearm;

a feature on an opposing end of the first tool component is exposed and extends outwards from the opposing sides of the main tool body when the first tool component is connected to the main tool body;

the first tool component being operable to perform at least one of the functions selected from the group comprising:

turning a firearm's rear sight screws, turning a firearm's buttstock screws, turning a firearm's front sling swivel screw, turning a firearm's stacking swivel screw, depressing and rotating a firearm's gas cylinder valve, removing a firearm's magazine floor plate, and opening a firearm's trapdoor when connected to the main tool body;

the tool kit further comprising:

a handle;

the handle having at least a first attachment facility;

the handle's first attachment facility being adapted to connect to the male attachment facilities on the cylindrical tool components;

one of the cylindrical tool components being operable to indicate the relative throat erosion wear condition of a firearm's gun barrel when connected to the handle.

9. A multifunction tool kit for firearm maintenance comprising:

a plurality of multiple function tool components;

the multiple function tool component having a first attachment facility and a second attachment facility;

a main tool body tool component;

the main tool body tool component having at least a first attachment facility and a second attachment facility;

the main tool body tool component's first attachment facility being adapted to receive the multiple function tool component's first and second attachment facilities simultaneously; and at least three of the tool components selected from the group comprising the following:

a thread protector tool component;

an aperture of the thread protector tool component's aperture being adapted to fit the multiple function tool component's first attachment facility;

the thread protector tool component having an aperture;

a muzzle wear gauge tool component;

the muzzle wear gauge tool component having a male attachment facility and a female attachment facility;

a throat erosion gauge tool component;

the throat erosion gauge tool component having a male attachment facility and a female attachment facility;

a trigger guard takedown tool component;

the trigger guard takedown tool component having at least one attachment facility adapted to receive the muzzle wear gauge tool component's male attachment facility and the throat erosion gauge tool component's male attachment facility;

a pin punch tool component;

the pin punch tool component having a male attachment facility terminating in a pin punch adapted to fit the muzzle wear gauge's female attachment facility;

the pin punch tool component's male attachment facility being adapted to fit the thread protector tool component's aperture and the muzzle wear gauge's female aperture;

a stock liner tool component;

the stock liner tool component having an attachment facility being adapted to fit the main tool body tool component's second attachment facility;

an alignment gauge tool component;

the alignment gauge tool component having a male attachment facility and a female attachment facility;

the alignment gauge tool component's male attachment facility being adapted to fit a third attachment facility on the main tool body tool component; and the alignment gauge tool component's female attachment facility been adapted to fit the multiple function tool Component's first attachment facility and the throat erosion gauge tool component's male attachment facility.

10. The toolkit of claim 9, wherein the main tool body tool component further comprises a socket that is operable to perform at least one of the functions selected from the group comprising:

holding a firearm's gas piston, turning a bolt, turning a nut, and greasing a firearm's bolt roller.

11. The tool kit of claim 9, wherein the muzzle wear gauge tool component's male attachment facility is connected to an attachment facility on the trigger guard takedown tool component so that markings on the exterior of the muzzle wear gauge tool component are operable to measure a firearm gun barrel rifling's wear condition.

12. The tool kit of claim 9, wherein the muzzle wear gauge tool component's male attachment facility is connected to the throat erosion gauge tool component's female attachment facility, and the throat erosion gauge tool component's male attachment facility is connected to an attachment facility on the trigger guard takedown tool component so that markings on the exterior of the throat erosion gauge tool component are operable to measure a firearm barrel's throat erosion wear condition.

13. The tool kit of claim 9, wherein the multiple function tool component's first attachment facility is connected to the throat erosion gauge tool component's female attachment facility, the throat erosion gauge tool component's male attachment facility is connected to the pin punch tool component's female attachment facility, and the pin punch tool component's male attachment facility is connected to the thread protector component's aperture to be operable to perform at least one of the functions selected from the group comprising:

pressing out pins in a firearm's trigger group, and pushing out a firearm's extractor leg from the underside of the firearm's bolt.

14. The tool kit of claim 9, wherein the multiple function tool component's first and second attachment facilities are connected to the main tool body tool component's first attachment facility to be operable to perform at least one of the functions selected from the group comprising:

turning a firearm's rear sight screws, turning a firearm's buttstock screws, turning a firearm's front sling swivel screw, turning a firearm's stacking swivel screw, depressing and rotating a firearm's gas cylinder valve, removing a firearm's magazine floor plate, and opening a firearm's trapdoor.

15. The tool kit of claim 14, wherein the alignment guide tool component's male attachment facility is connected to the main tool body tool component's third attachment facility with a sealing gasket between them to form a watertight storage container within the main tool body tool component.

16. The tool kit of claim 9, wherein the multiple function tool component's first attachment facility is connected to the thread protector tool component's aperture to be operable to perform at least one of the functions selected from the group comprising:

applying grease to a firearm, scraping a firearm's bolt face;

cleaning a firearm's gas piston grooves, pushing a firearm's connector lock open, removing a firearm's rear sight spring cover, and a firearm extractor claw scraper with or without the extractor claw being removed from the bolt.

17. The tool kit of claim 9, wherein the alignment guide tool component's male attachment facility is connected to the main tool body tool component's third attachment facility, and the throat erosion gauge tool component's male attachment facility is connected to the alignment gauge tool component's female attachment facility to be operable to align a firearm's muzzle device with the firearm's muzzle.

18. The tool kit of claim 9, wherein the stock liner tool component's attachment facility is connected to the main tool body tool component's second attachment facility to be operable to turn a firearm's stock liner screws.

19. The tool kit of claim 9, further comprising:

the main tool body tool component's second attachment facility having at least one retention device receiver therein;

the stock liner tool's attachment facility having a retention device protruding therefrom; and wherein the retention device seats in the retention device receiver in the main tool body tool component's second attachment facility to retain the stock liner tool's attachment facility therein.

* * * * *